United States Patent [19]

Weiss

[11] Patent Number: 4,848,175

[45] Date of Patent: Jul. 18, 1989

[54] APPARATUS FOR MOVING PIVOTABLE GATES AND THE LIKE

[75] Inventor: Adrian U. Weiss, Kaiseraugst, Switzerland

[73] Assignee: Magnetic-Elektromotoren GmbH, Maulburg, Fed. Rep. of Germany

[21] Appl. No.: 194,027

[22] Filed: May 13, 1988

[30] Foreign Application Priority Data

May 13, 1987 [DE] Fed. Rep. of Germany ..... 3715936

[51] Int. Cl.[4] ..... F16H 21/44; E05F 15/12; E06B 3/32

[52] U.S. Cl. ..... 74/96; 49/340; 49/345; 49/380

[58] Field of Search ..... 74/96, 97; 49/339, 340, 49/341, 345, 380, 386

[56] References Cited

U.S. PATENT DOCUMENTS

| | | | |
|---|---|---|---|
| 1,354,787 | 10/1920 | Voina-Hansen | 49/341 X |
| 2,530,666 | 11/1950 | Sigel | 49/345 X |
| 2,738,972 | 3/1956 | Morris | 49/340 X |
| 3,332,169 | 7/1967 | Lohr et al. | 49/340 X |
| 4,125,966 | 11/1978 | Penn | 49/380 X |
| 4,136,578 | 1/1979 | Van Klompenburg | 49/345 X |

FOREIGN PATENT DOCUMENTS

| | | |
|---|---|---|
| 2254231 | 6/1973 | Fed. Rep. of Germany . |
| 7930545 | 2/1980 | Fed. Rep. of Germany . |
| 3209608 | 9/1983 | Fed. Rep. of Germany . |

*Primary Examiner*—Allan D. Herrmann
*Attorney, Agent, or Firm*—Peter K. Kontler

[57] ABSTRACT

Apparatus for moving a pivotable gate or the panel of a swinging door has a U-shaped or H-shaped frame with a plate-like web which supports a motor and two flanges which carry a turnable output shaft receiving motion from the motor by way of a linkage. The motor serves to turn the output shaft to one end position and one or more springs are used to permanently bias the output shaft to another end position. The web has holes for screws which are used to secure the frame to a housing or a like support, e.g., in a recess so that the web overlies the open side of the recess and the output shaft is located externally of the housing to be connectable to or detachable from a gate or a door panel. The frame and the parts thereon can be assembled at the manufacturing plant into a self-sustaining module.

25 Claims, 8 Drawing Sheets

APPARATUS FOR MOVING PIVOTABLE GATES AND THE LIKE

BACKGROUND OF THE INVENTION

The invention relates to improvements in apparatus for moving pivotable gates or turnstiles, swingable door panels, pivotable shackles or straps and the like. More particularly, the invention relates to improvements in apparatus which can serve to move one or more components between predetermined first and second end positions.

Heretofore known apparatus of the above outlined type are normally provided with a frame member for a prime mover, with a frame member for the output element which carries the pivotable component or components, a frame member for motion transmitting parts which establish an operative connection between the prime mover and the output element, and a frame member for the spring or springs which are or can be provided to bias the output element to one of its positions. The motion transmitting parts can comprise one or more levers and/or links, and the springs can be connected to a coupling lever which is affixed to the output element so that the springs are capable of turning the output element when the prime mover permits such angular movement of the output element. Reference may be had, for example, to German Offenlegungsschrift No. 2 254 231 of Weiss which describes an apparatus serving to move the panels of swinging doors. Such apparatus can also be used to pivot gates or other types of barriers, e.g., at the entrances to ski lifts, in supermarkets and elsewhere.

A drawback of the just described conventional apparatus is that its space requirements are excessive and that the installation of such apparatus is a complex and time-consuming operation. This is due, in part, to the fact that the apparatus employs a number of discrete frame members. The support for such apparatus must be provided with one or more doors which afford access to the parts and contribute to the bulk and cost of the entire assembly. Moreover, it is difficult, if not impossible, to assemble the entire apparatus at the manufacturing plant; this also contributes to the cost of installation, inspection, repair and replacement.

German Utility Model No. 79 30 545 of Vereinigte Beschlagfabriken Gretsch & Co GmbH discloses an apparatus which can actuate the panel or panels of a swinging door and comprises an electric motor which is installed in a housing and transmits motion to a worm drive. The housing includes an elongated base plate and a hood and constitutes a hollow prismatic body. The apparatus further includes a two-stage stepdown gear transmission having at least four gears. The output shaft, an intermediate shaft and a third shaft of the apparatus are installed in a housing block which is secured to the base plate. All this contributes to the bulk and cost of the apparatus.

German Offenlegungsschrift No. 32 09 608 of Weiss discloses another apparatus which can be used to move the panels of swinging doors, to move pivotable gates and for other purposes. The inventor emphasizes the design of the control circuitry for the electric motor. The motor and numerous other parts are mounted in an elongated housing.

OBJECTS AND SUMMARY OF THE INVENTION

An object of the invention is to provide a novel and improved apparatus which can be used to pivot gates, door panels, turnstiles and like components and is simpler, more compact and less expensive than heretofore known apparatus.

Another object of the invention is to provide a novel and improved frame for use in the above outlined apparatus.

A further object of the invention is to provide an apparatus which can be installed in or on small and compact supports in any one of a plurality of different positions and in such a way that the entire apparatus can be detached and another apparatus attached with little loss in time.

An additional object of the invention is to provide an apparatus which can be fully assembled at the manufacturing plant.

Still another object of the invention is to provide the apparatus with novel and improved means for transmission motion from the prime mover to the output element which turns and/or otherwise moves a gate, a turnstile, a door panel or the like.

A further object of the invention is to provide an apparatus which is constructed and assembled in such a way that all of its parts are readily accessible for inspection, repair or replacement.

Another object of the invention is to provide an apparatus which can be used in any one of a number of different positions to turn the output element about a vertical, horizontal or otherwise oriented axis.

The apparatus of the present invention can be used to move a pivotable gate or an analogous mobile component and comprises a self-supporting frame including a first and second section and means for attaching the frame to a support, such as a portion of a door, a bracket or a wall. The apparatus further comprises a prime mover (e.g., an electric motor) which is mounted on or in the frame, an output element (e.g., a rotary shaft) which is connectable with the mobile component and is mounted in or on the first section of the frame for movement between first and second positions, a system of levers and/or links or other suitable means for transmitting motion from the prime mover to the output element so as to move the output element to the first position in response to actuation of the prime mover, and means for biasing the output element to the second position. The biasing means is mounted on the second section of the frame. Means (e.g., a lever or a link) can be provided for coupling the biasing means to the output element.

The frame preferably further comprises a substantially plate-like third section which can constitute the web of a substantially U-shaped or a substantially H-shaped body. The prime mover is or can be mounted on the third section of the frame, and the first section can comprise a plurality of flanges or legs which extend from one side of the third section and have bearings for the output element. It is presently preferred to provide two flanges or legs each of which has a substantially trapeziform shape and which are disposed in spaced-apart parallel or nearly parallel planes substantially at right angles to the third section or web of the frame. The second section of the frame can include a second pair of legs each of which can constitute an extension of a flange or leg of the first section. The web or third section of such substantially H-shaped frame is disposed between the first pair of legs which form part of or constitute the first section and the second pair of legs which constitute or form part of the second section. One leg of the second pair of legs can be provided with at least one opening for a portion of the motion transmitting means. This renders it possible to mount the prime mover between the legs of the second pair and to install at least one member of the motion transmitting means at the outer side of the one leg of the second pair.

The preferably plate-like third section or web of the frame can extend transversely of the output element and can include at least one portion which projects or extends beyond the legs of the second pair of legs. The aforementioned attaching means is preferably provided in or on such portion of the third section. In accordance with a presently preferred embodiment of the apparatus, the third section of the frame has two end portions which extend beyond the legs of the second pair of legs, i.e., the second section of the frame is disposed between the end portions of the third section. Each such end portion of the third section can be provided with means which facilitate attachment of the frame to a suitable support. The attaching means can include holes in the end portions of the third section of the frame.

The third section of the frame can be provided with at least one aperture for the biasing means. The latter can comprise at least one spring which moves relative to the third section of the frame in response to movement of the output element between its first and second positions. The size of the aperture is preferably selected in such a way that the spring is out of contact with the third section of the frame in each and every position of the output element, i.e., in the first and second positions as well as in each intermediate position between the first and second positions. It is often preferred to employ biasing means which comprises a plurality of springs (e.g., elongated coil springs); the third section of the frame is then preferably provided with a discrete aperture for each spring. Such apertures can constitute or resemble elongated slots which form a row and each of which can extend transversely of the output element.

The frame, the prime mover, the output element, the motion transmitting means and the biasing means can be assembled at the manufacturing plant into a prefabricated module which is ready to be attached to a suitable support. The support for such module can be provided with a recess having an open side. The plate-like third section of the properly installed module can extend across the open side of the recess, the second section of the frame and the prime mover can be disposed in the recess, and the first section and the output element of the apparatus can be located outside of the recess so that the output element can be readily coupled to a swingable gate or the like. If the open side is the top side of the recess, the plate-like third section of the frame is preferably horizontal and is located above the prime mover and the second section but beneath the first section and the output element.

If the biasing means comprises one or more coil springs, the second section of the frame can be provided with a substantially rod-shaped carrier for one end portion of each spring.

One or more limit switches and/or other elements of the control means for the prime mover can be installed on at least one flange or leg of the first section or on the web of the frame so that such element or elements of the control means can be engaged by the output element and/or by a component which is coupled to and receives motion from the output element. Furthermore, the frame can support one or more abutments or other suitable means for limiting the movability of the output element relative to the frame. For example, one leg of the second section of the frame can carry two spaced-apart abutments in the path of movement of one part of the motion transmitting means.

If the output element is turnable (rotatable) between its first and second positions, the biasing means can comprise at least one torsion spring with convolutions (preferably helical convolutions) which loosely surround the output element, e.g., a portion of a shaft- or axle-like output element between the flanges or legs of the first section of the frame. The torsion spring can constitute the entire biasing means. This renders it possible to greatly reduce the dimensions of the frame because the second section of such frame can merely include a projection (e.g., a collar) on the output element. The torsion spring can have a first terminal anchored in one flange or leg of the first section of the frame (preferably in that flange or leg which is remote from the prime mover) and a second terminal anchored in the aforementioned projection. This ensures that the torsion spring is compelled to store energy when the output element is turned by the prime mover to move to its first position; when the prime mover permits it (and/or when a brake or the like permits it), the torsion spring is free to dissipate energy and to move the output element to the second position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
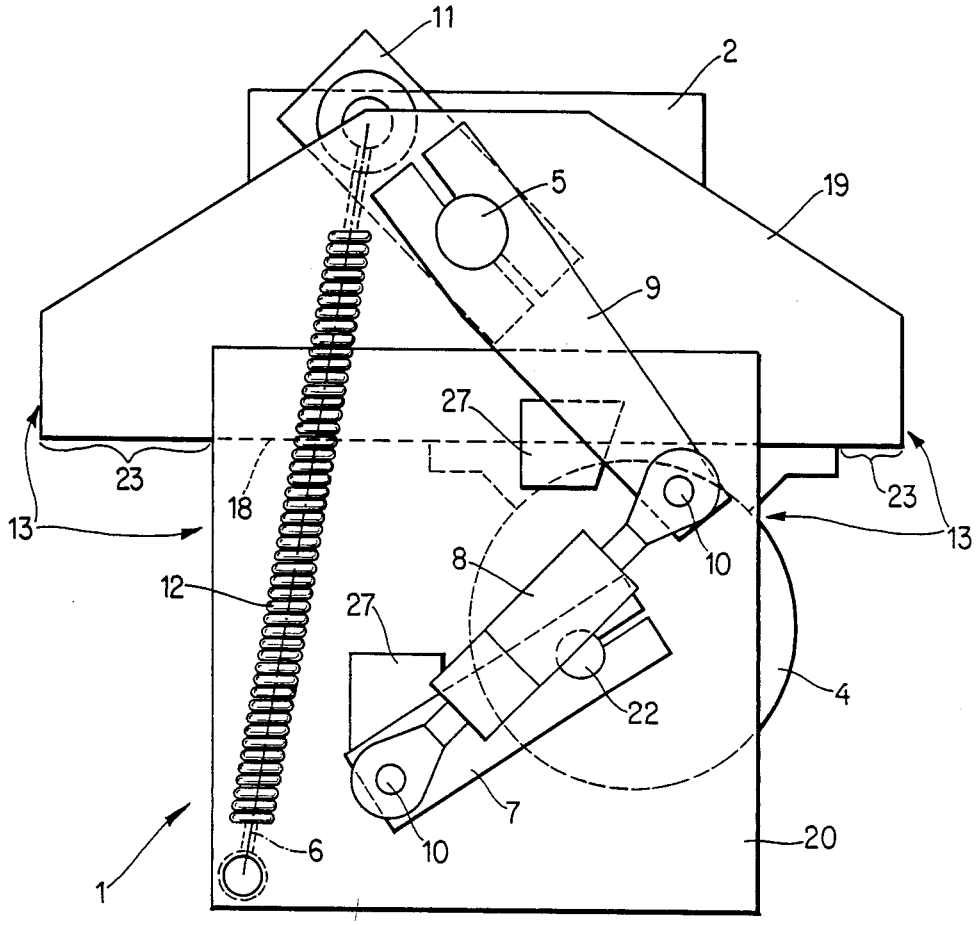
FIG. 1 is a side elevational view of apparatus which embodies one form of the invention, the output element being shown in one of its end positions and the component which is coupled with the output element be located behind the frame.
Figure 2:
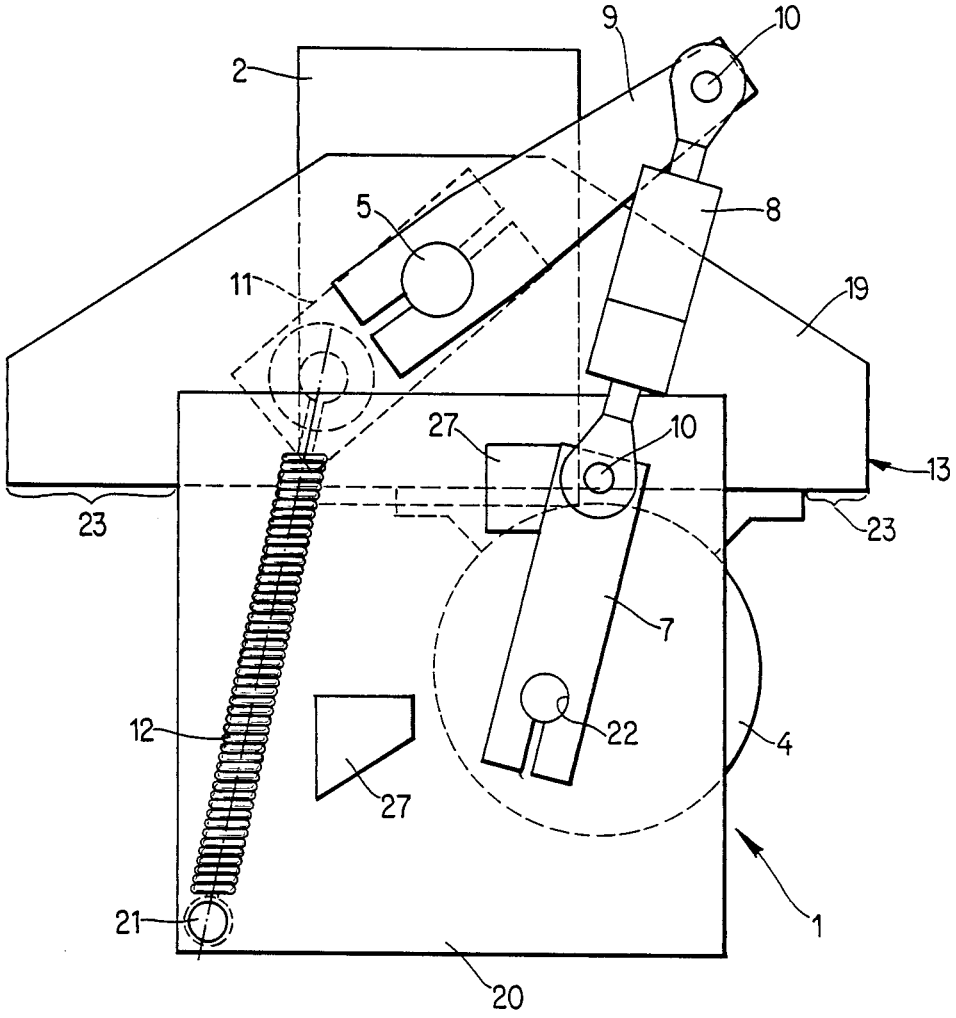
FIG. 2 is a similar side elevational view but showing the out in the other end position.
Figure 4:
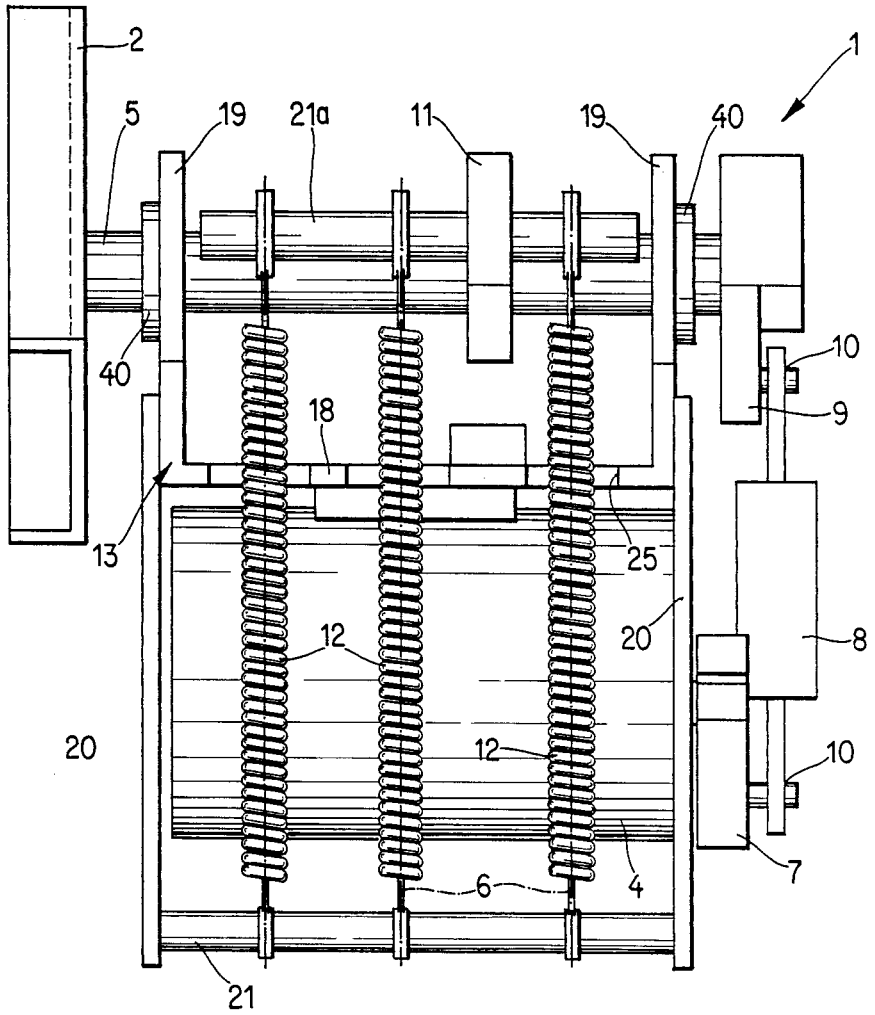
FIG. 4 is an end elevational view as seen from the left-hand side of FIGS. 1 or 2.
Figure 5:
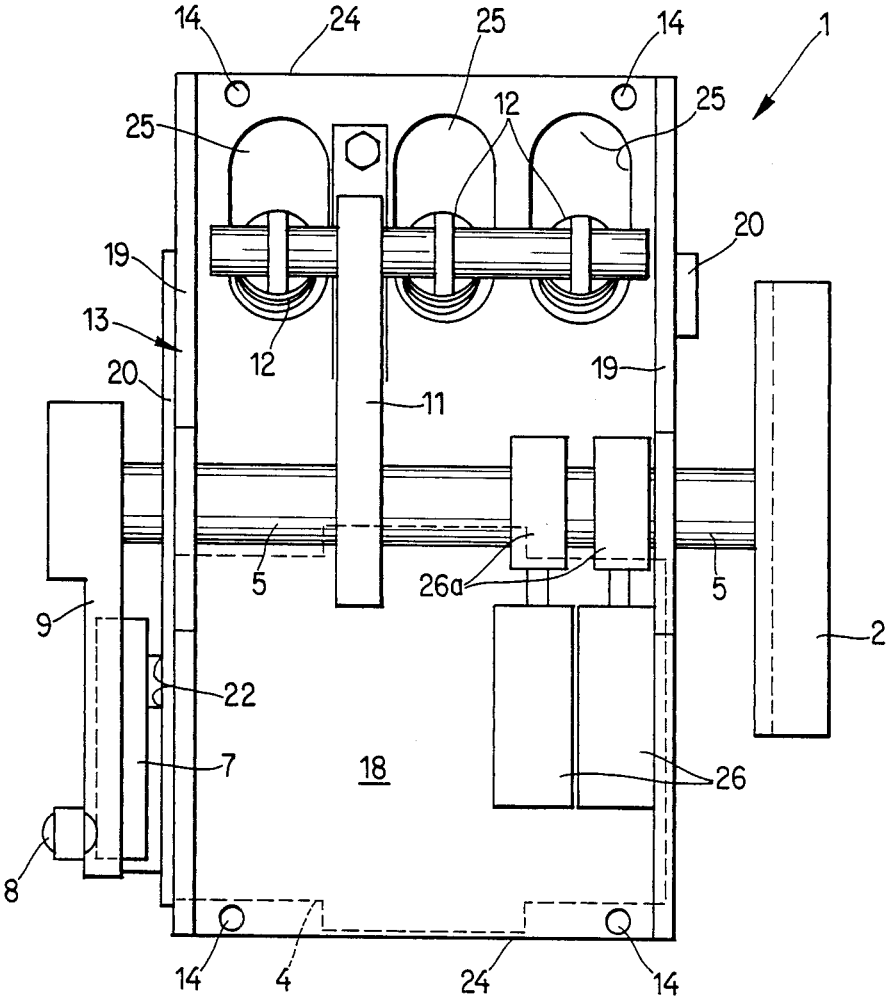
FIG. 5 is a plan view of the apparatus.
Figure 8:
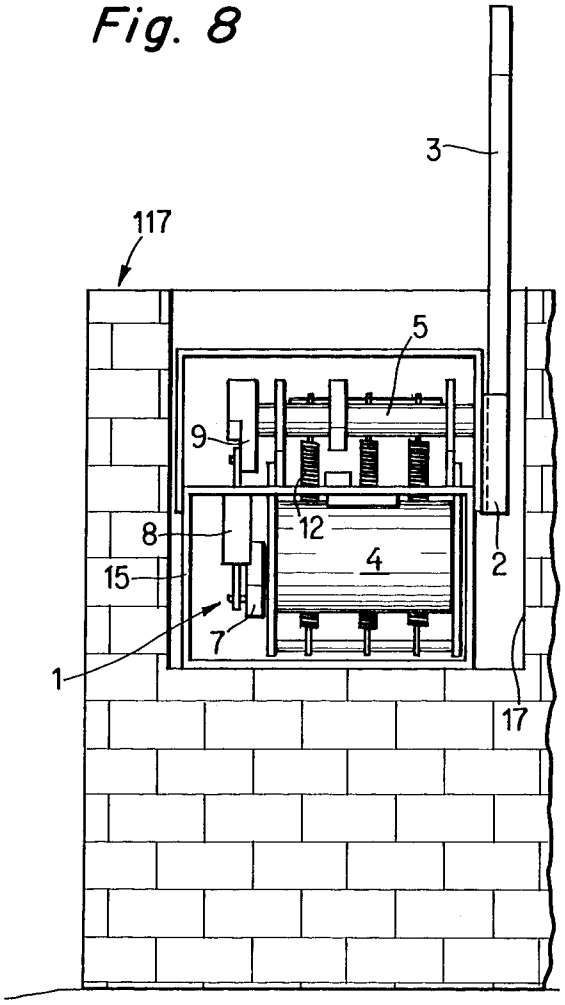
FIG. 8 is a similar end elevational view of the apparatus but with the frame attached to a support in the recess of wall.
Figure 7:
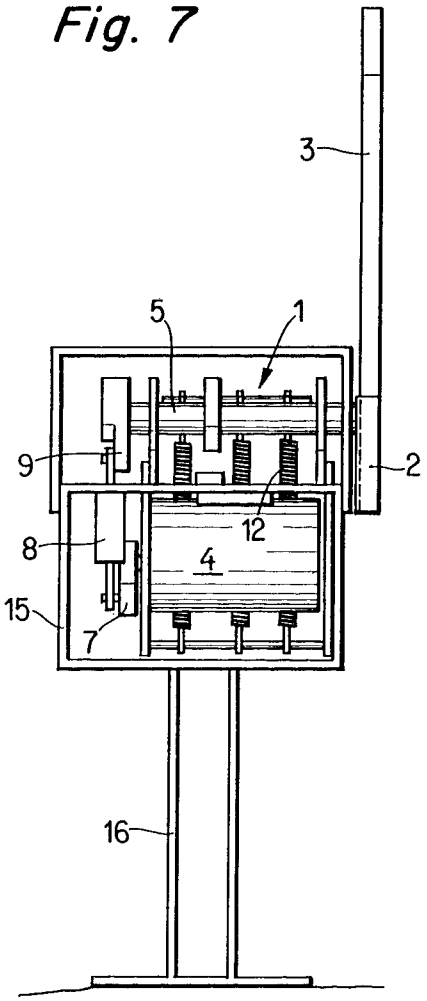
FIG. 7 is a similar end elevational view of the apparatus but with the frame attached to a support on top of a column.
Figure 6:
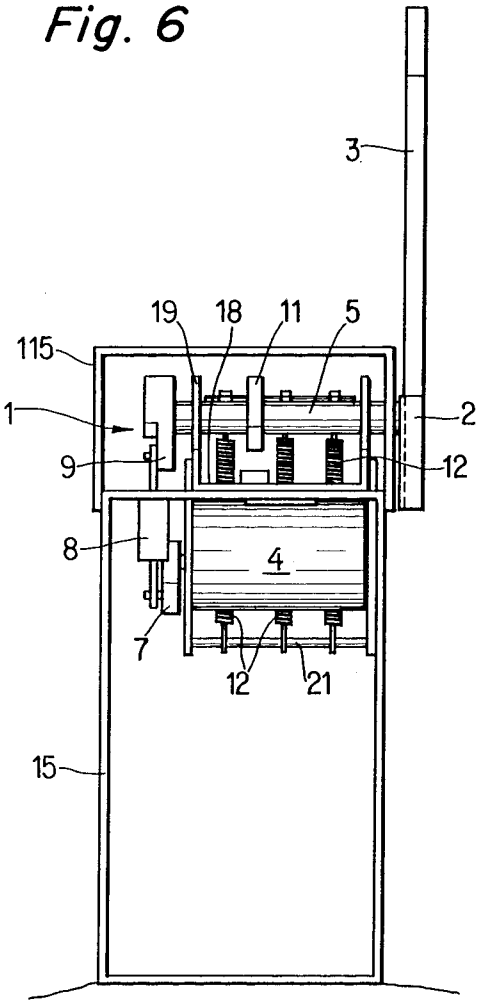
FIG. 6 is another end elevational view of the apparatus, with the frame attached to a support and with the output element coupled to a gate which is pivotable in a vertical plane.

The apparatus 1 which is shown in FIGS. 1 to 8 serves to move (pivot) a component 2 between a first position which is shown in FIG. 1 and a second position which is shown in FIG. 2. As shown in FIGS. 6 to 8, the component 2 can be separably or permanently connected with a gate 3 to pivot such gate between a raised position (shown in each of FIGS. 6–8) and a lowered (e.g., substantially horizontal) position in which the gate extends across a portion of or across an entire road, aisle, walkway or the like. It is equally possible to install the apparatus 1 in such a way that the component 2 (and a gate 3 which is connected thereto) is pivotable about a vertical axis, i.e., the gate can move in a horizontal or nearly horizontal plane. The apparatus 1 can be used with equal or similar advantage in supermarkets to actuate turnstiles, in connection with ski lifts and for a host of other purposes. Still another presently preferred field of utilization of the improved apparatus 1 is to serve as a means for moving the panels of swinging doors. It is even possible to employ the apparatus 1 as a means for pivoting a gate or the like between a horizontal position and an inoperative position in which the gate extends downwardly, instead of extending upwardly in a manner as shown in FIGS. 6 to 8.

The apparatus of FIGS. 1 to 8 comprises a self-sustaining substantially H-shaped frame 13 having a first section including two flanges or legs 19 which are disposed in parallel planes and are spaced apart from each other, a second section including two legs 20 each of which can resemble or constitute an extension of one of the flanges or legs 19, and a third section 18 which resembles a plate and constitutes the web of the substantially H-shaped frame 13. The section or web 18 supports a prime mover 4, e.g., an electric torque motor, which is nearer to one than to the other flange or leg 19. A torque motor can be blocked while its circuit remains completed. The flanges 19 of the first section of the frame 13 have bearings 40 for spaced-apart portions of an output element 5 which is an elongated shaft capable of being rocked back and forth between two end positions in one of which the gate 3 is maintained in the raised or inoperative position of FIGS. 6, 7 or 8 and in the other of which the gate 3 is substantially horizontal so that it extends across a road, aisle, walkway or the like.

The second section including the extensions or legs 20 of the frame 13 supports the end portions of an elongated rod-shaped or bar-shaped carrier 21 for the respective end portions of three elongated coil springs 12 which constitute a means for yieldably biasing the output element 5 and the component 2 (with the gate 3) to one of the two end positions, preferably to the end positions shown in FIGS. 6–8 in which the gate 3 is lifted. This ensures that the coil springs 12 can automatically raise the gate 3 if the prime mover 4 is out of commission. The other end portions of the coil springs 12 are connected to a bar or rod-shaped carrier 21*a* which is coupled to the output element 5 by a lever 11. The latter is rigidly affixed to the output element 5 between the flanges 19. As can be seen from a comparison of FIGS. 1 and 2, the axes 6 of the springs 12 move relative to the frame 13 when the output element 5 is caused to move between the two end positions. Since the springs 12 extend through the plate-like section or web 18, the latter is provided with elongated slot-shaped apertures 25 (see particularly FIG. 5) for the adjacent portions of the three springs. Each aperture 25 receives a discrete coil spring 12, and the dimensions of these apertures are preferably selected with a view to ensure that the convolutions of the springs 12 do not contact the web 18 while the output element 5 is caused to turn between its end positions. FIG. 5 shows that the apertures 25 form a row of parallel elongated slots or holes which extend transversely of the output element 5.

The apparatus 1 further comprises means for transmitting motion from the prime mover 4 to the output element 5, and such motion transmitting means comprises a one-armed lever 7 which is clamped to the output shaft of the prime mover 4, a link 8 which is articulately connected to the free end of the lever 7 by a pivot pin 10, and a lever 9 which is clamped to the output element 5 and is articulately connected to the link 8 by a second pivot pin 10. The output shaft of the prime mover 4 extends through an opening 22 in one of the legs 20, and the parts 7, 8, 9 of the motion transmitting means are disposed externally of the frame 13, namely at the outer sides of the respective flange 19 and leg 20. The lever 11 can constitute an extension of the lever 9 or vice versa, i.e., these levers can be replaced with a single two-armed lever which is rigidly secured to the output element 5.

As can be seen in FIGS. 4 and 5, the frame 13, the output shaft 5, the coil springs 12, the prime mover 4 and the motion transmitting means 7–10 together constitute a module which can be fully assembled in the manufacturing plant and is then ready to be attached to a support, such as the housing 15 which is shown in FIG. 6. In FIG. 7, the housing 15 for the module including the frame 13 and the parts mounted thereon is carried by a column 16, and in FIG. 8 the module is installed in part in a housing 15 which, in turn, is installed in a recess or niche 17 provided in one side of a brick wall 117.

The frame 13 is provided with means 14 for attaching it to the housing 15 or to another suitable support. Actually, the illustrated attaching means 14 are simple round holes which are provided in the end portions 23 of the web 18. As can be seen in FIGS. 1 to 5, the web 18 extends transversely of the output element 5 and is longer than the legs 20, i.e., the two end portions 23 of the web 18 extend beyond the respective ends of the legs 20, and the holes 14 are provided in the end portions 23. This renders the holes 14 readily accessible for the shanks of screws or like fasteners which are used to permanently or detachably secure the frame 13 to the support (such as the housing) 15. The entire module is compact and relatively simple and can be installed in or on its support in a number of different ways. Moreover, and if the installed module is out of commission, such module can be readily replaced with a spare module by the simple expedient of removing the bolts or screws which extend through the holes 14 and serve to affix or attach the web 18 of the frame 13 to its support. The number of coil springs 12 can be increased or reduced without departing from the spirit of the invention. Relatively strong springs 12 will be used if the gate 3 is rather heavy and the lever 11 is relatively short.

Figure 9:
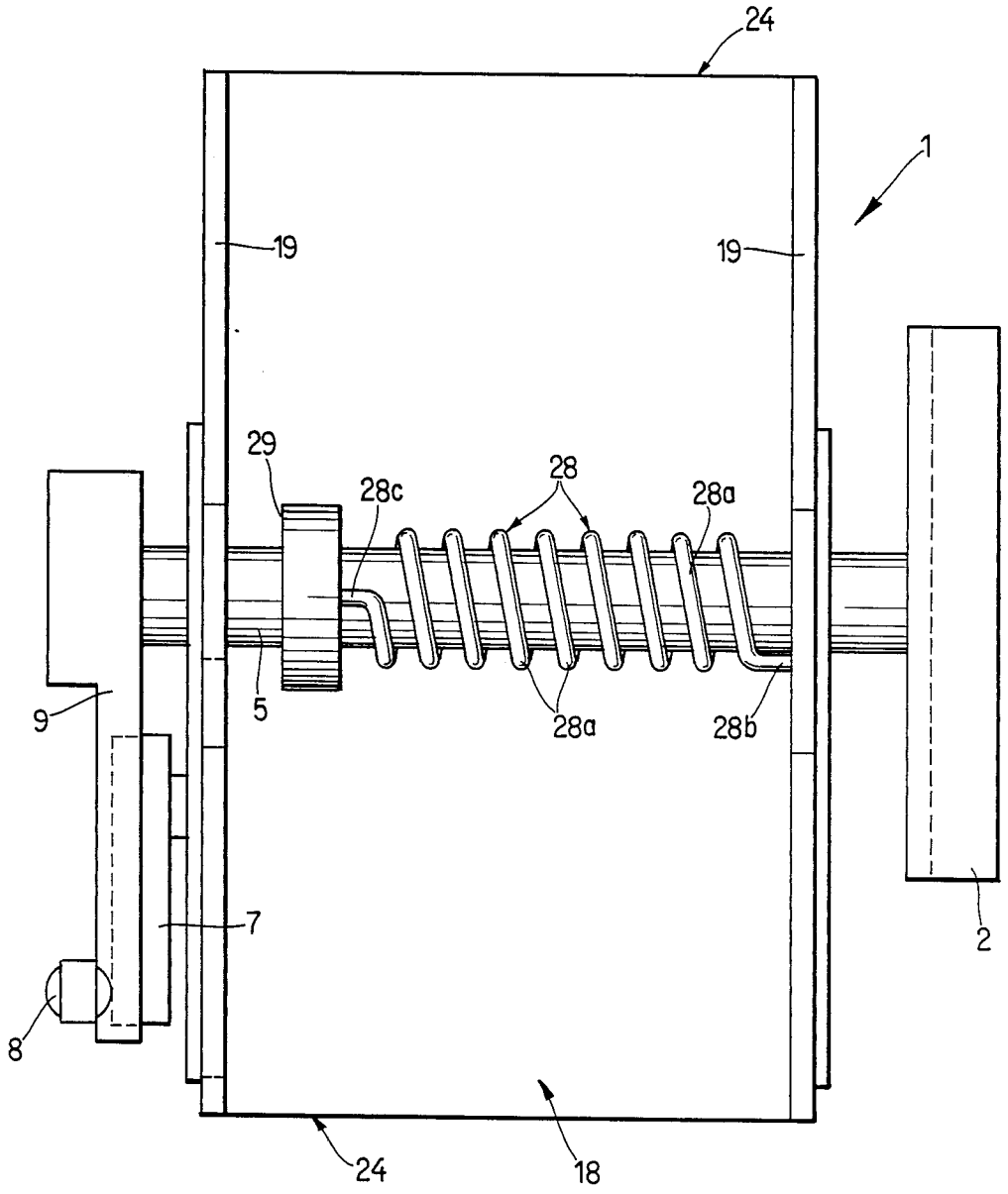
FIG. 9 is a plan view of a modified apparatus wherein the biasing means for the output element consists of a single torsion spring.

If the legs 20 are omitted (e.g., if the coil springs 12 of the apparatus 1 of FIGS. 1 to 8 are replaced with a biasing means employing a single torsion spring, such as the torsion spring 28 of the apparatus which is shown in FIG. 9), the frame resembles a substantially U-shaped body with a web 18 and two spaced-apart parallel flanges or legs 19. The section including the legs 20 is then replaced with a projection 29 which is rigid with the output element 5.

Figure 3:
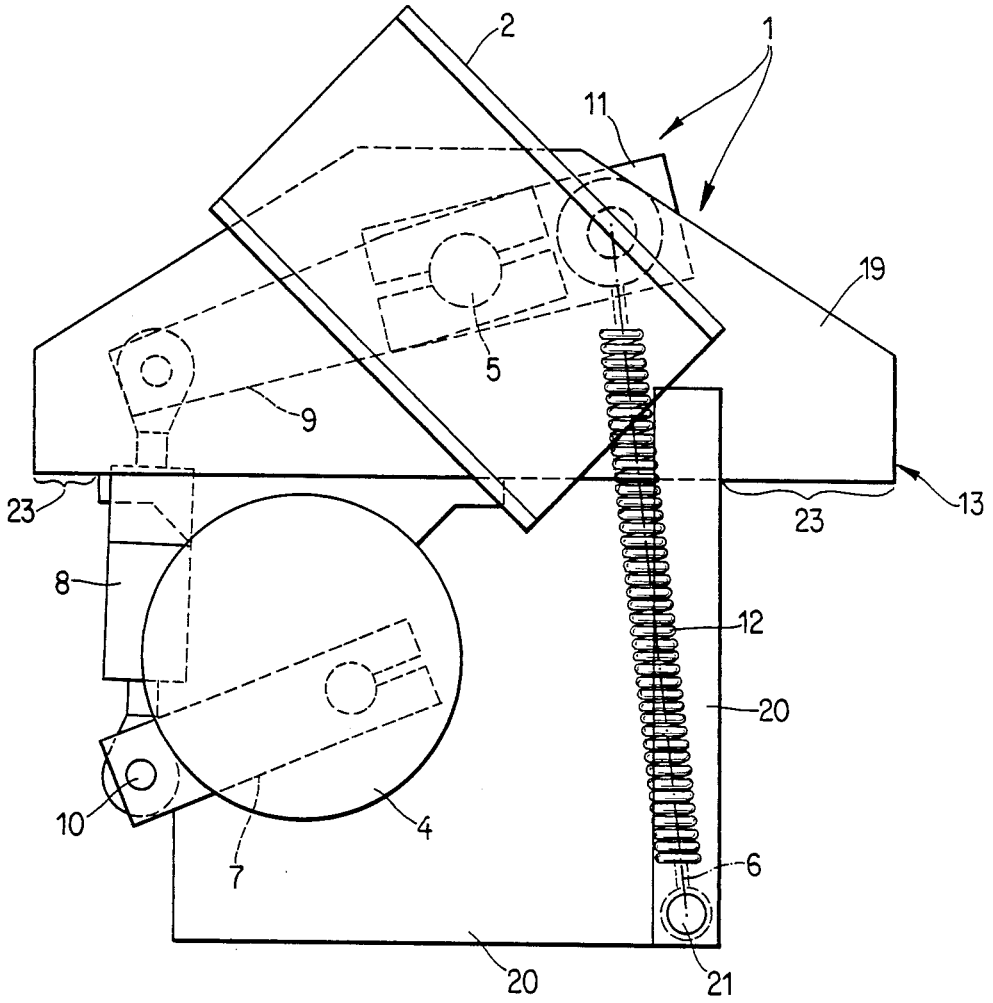
FIG. 3 is another side elevational view of the apparatus, with the output element shown in an intermediate position and with the component which receives motion from the output element located in front of the frame.

The prime mover 4 is disposed in the space between the web 18 and the legs 20 and, as shown in FIG. 4, need not abut both legs 20. The coil springs 12 of the apparatus 1 are adjacent one side of the prime mover 4 (see particularly FIGS. 1 to 3). FIGS. 1 to 3 further show that the length of the flanges 19 can equal the length of the web 18 (as considered at right angles to the axis of the output element 5). However, it is clear that the flanges 19 can be shorter than the web 18, or vice versa. FIG. 5 shows that the holes 14 are closely adjacent the respective edge faces 24 of the web 18; these edge faces are parallel to the axis of the output element 5. FIG. 5 also shows that the web 18 has four holes 14, two adjacent each edge face 24. However, the number of such holes can be reduced or increased depending upon the overall weight of the module including the frame 13 and the weight of the component or components which are coupled to the output element 5. Four holes 14 normally suffice if the apparatus 1 is installed in such position that the web 18 is horizontal or nearly horizontal (see FIGS. 6 to 8). The screws or other suitable fasteners which are used to secure the web 18 to the support 15 are then called upon to oppose (primarily or exclusively) lateral shifting of the frame 13 and its sections 19—19, 20—20 and 18.

FIG. 6 shows that the web 18 overlies the open upper side or top side of the support or housing 15. The legs 20, the prime mover 5 and the major portions of the coil springs 12 are confined in the recess of the housing or support 15 beneath the open upper side, and the flanges 19 with the output element 5 are located at a level above the web 18 so that the component 2 and the gate 3 are readily accessible. The web 18 can be said to constitute a frame section which bridges the open top of the support or housing 15. A separate cover 115 can be provided to overlie the flanges 19 and the output element 5 as well as to shield the adjacent parts of the motion transmitting means 7–10 when the apparatus is properly installed and is in use. Once the cover 115 is removed, the entire module including the frame 13 and the afore enumerated parts which are mounted on its sections can be detached from the housing or support 15 by the simple expedient of removing the fasteners which extend through the holes 14 of the web 18.

The output element 5 is journalled in those portions of the flanges 19 which are remotest from the web 18. At least one of the flanges 19 and/or the web 18 can carry one or more elements of the controls for the prime mover 4, e.g., one or more limit switches 26 located in the path of movement of trips **26*a* which turn with the output element 5. The limit switches 26 can be used to start or arrest the motor 4. Instead of being mounted on one of the flanges 19, the limit switches 26 can be mounted on the web 18. Mounting of control elements in the space between the flanges 19 and the web 18 is desirable and advantageous because such elements are less likely to be contacted by a person or exposed to dust, moisture or other contaminants, especially when the cover 115 is affixed to the support or housing 15**.

The extent of angular movement of the output element 5, component 2 and gate 3 can be limited by suitable abutments 27 (FIGS. 1 and 2) which can be mounted at the outer side of one of the legs 20 and are located in the path of movement of a part which shares the movements of or transmits motion to the output element 5, e.g., in the path of movement of the lever 7. The arrangement is or can be such that the prime mover 4 turns the lever 7 into direct engagement with one of the abutments 27 (FIG. 1) and the springs 12 move the lever 7 into direct engagement with the other abutment 27 (FIG. 2) when the motor 4 permits the output element 5 to turn counterclockwise as seen in FIG. 2.

The left-hand leg 20 of FIG. 4 can be replaced with a simple rod, bar or a like part which merely serves to support the respective end portion of the carrier 21 for the adjacent end portions of the coil springs 12 (see the right-hand leg 20 of FIG. 5). This can entail a reduction of the weight and cost of the module including the frame 13, the prime mover 4, the output element 5, the springs 12 and the motion transmitting means 7–10.

FIG. 9 shows a modified apparatus 1 which employs a smaller and less expensive frame as well as a single spring 28, i.e., a torsion spring with helical convolutions **28*a* which loosely surround the output element 5 between the flanges 19. One terminal (28*b*) of the torsion spring 28 is anchored in one of the flanges 19 and the other terminal (28*c*) is anchored in the aforementioned projection 29 which is affixed to the output element 5 and can be said to constitute a section of the frame. The latter further includes the plate-like web 18 which supports the prime mover 4 (not shown in FIG. 9). The attaching means (not shown in FIG. 9) of the web 18 can be identical with the attaching means 14 of the web 18 which is shown in FIG. 5**.

An advantage of the apparatus of FIG. 9 is its compactness. The torsion spring 28 occupies a minimum of space between the flanges 19, and the frame of this apparatus is a substantially U-shaped body with the web 18 and legs or flanges 19. It is clear that the torsion spring 28 of FIG. 9 can be used in addition to the coil springs 12 of FIGS. 1–8. The utilization of biasing means consisting of a single torsion spring 28 is preferred if compactness is an important feature of the improved apparatus. In the embodiment which is shown in FIG. 9, the terminal **28*b* of the torsion spring 28 is anchored in that flange 19 which is remote from the prime mover, and the projection 29 for the terminal 28*c* is adjacent but spaced apart from the other flange 19. The convolutions 28*a* should surround the output element 5 with a play which suffices to enable the spring 28 to reduce the dimensions of its convolutions when it is caused to store energy in response to turning of the output element 5** to the respective end position.

An important advantage of the improved apparatus is that the frame 13 is independent of the support 15 or any other support as well as that the frame and the parts thereon can be fully assembled into a self-sustaining module in the manufacturing plant. This simplifies the installation of such apparatus at the locus of use as well as the removal of such apparatus from the selected support for the purposes of inspection, repair or replacement. The support for the module can include a housing (15) which can be mounted on the ground, on the floor or on a column (16) or the like, a wall (117), the frame of a swinging door, a bracket and/or others. The module can be readily designed in such a way that it can be installed in or on any one of a wide variety of supports so that the designer of the support has freedom of choice in selecting the size and/or shape of the support. All that is necessary is to properly select the locations of attaching means 14 on the frame 13 and the locations of corresponding attaching means on the support in order to ensure that the frame 13 can be affixed to the support in a simple and time-saving manner as well as with a view to afford access to all such parts which necessitate frequent or at least sporadic inspection, lubrication, repair or replacement. If the entire apparatus must be returned to the plant or inspected or repaired in a workshop, such apparatus can be replaced with a spare apparatus, even for relatively short intervals of time. This is possible because detachment of an installed apparatus and/or the installation of repaired or inspected or new apparatus in or on a support takes up little time and does not necessitate the utilization of any special tools.

The feature that the sections 19—19 and 18 of the frame 13 together constitute a substantially U-shaped body also contributes to simplicity, compactness and utility of the entire apparatus. Thus, the parts which are mounted on such sections of the frame 13 are readily accessible, the parts which must be protected can be adequately shielded between the two flanges 19, and the attaching means 14 are also accessible for the application or removal of screws or other types of fasteners.

If the improved apparatus must be furnished with one or more relatively large and strong springs (such as the coil springs 12), the springs can be readily accommodated in or on the frame 13 by the simple expedient of employing arms 20 of requisite length so that the carrier 21 (which defines a fulcrum for the springs 12) can be disposed at an optimum distance from the web 18 and carrier 21*a*. In other words, by the simple expedient of employing a substantially H-shaped frame in lieu of a substantially U-shaped frame, one can provide room and a support for one or more relatively long and strong coil springs or other suitable means for biasing the output element 5 to one of its end positions. As shown, the legs 20 of the second section of the frame 13 can further serve as means for supporting one or more parts of the motion transmitting means as well as to partially confine the prime mover 4. The dimensions of the flanges 19 and the distance of the output element 5 from the web 18 and prime mover 4 is or can be selected with a view to render it possible to employ an adequate motion transmitting system without unduly increasing the bulk and space requirements of the apparatus.

The means for starting the prime mover in a sense to lift the gate 3, to open a swinging door, to enable a turnstile to afford access to a ski lift and/or for other purposes can include a pushbutton, a knob, a lever, a card with encoded information thereon, coins or other well known means. The biasing means (12 or 28) ensures that a pivotable door can be shut automatically in the event of a fire, e.g., when the prime mover 4 is disconnected from the energy source, so as to prevent the flames and/or smoke from spreading in or beyond the burning establishment. It is further clear that the prime mover 4 can be mounted with a view to effect the closing of a swinging door if it is desired that the biasing means serve to automatically open the door.

Figure 10:
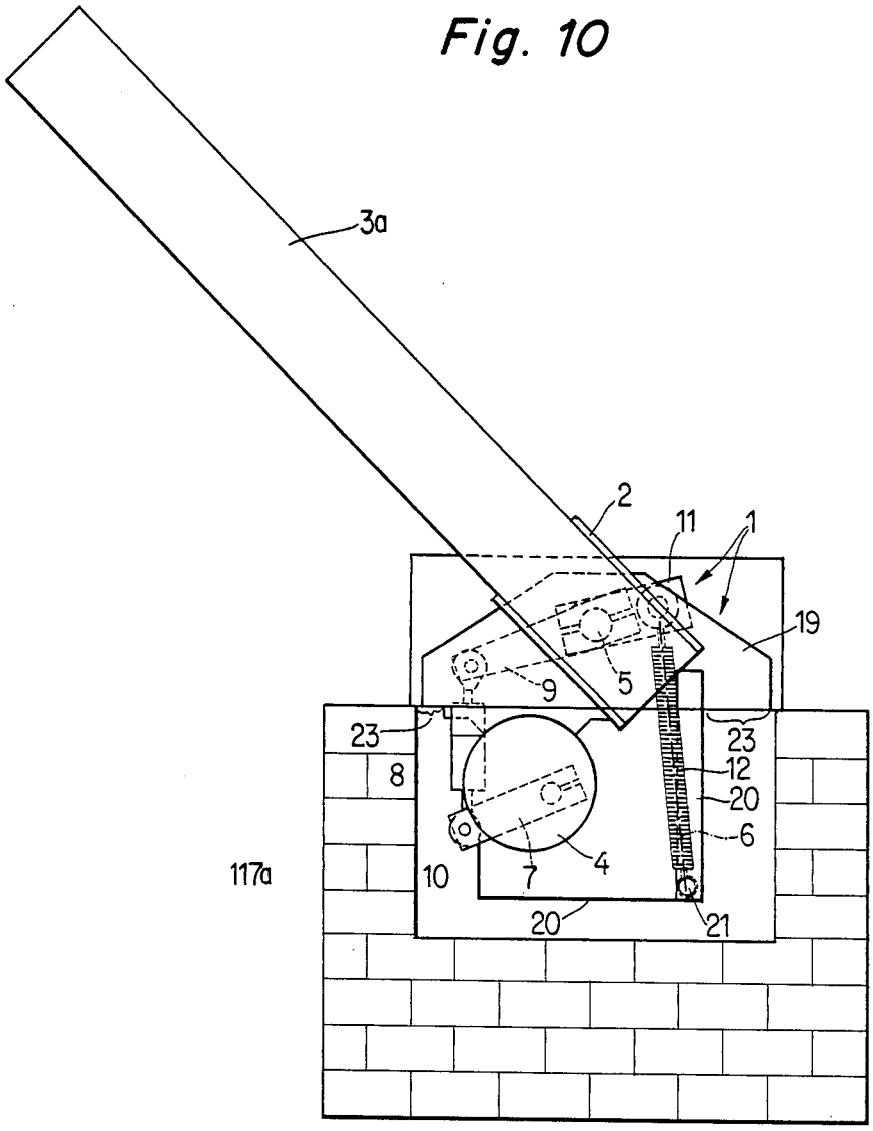
FIG. 10 is a plan view showing the apparatus of FIGS. 1–8 mounted on a doorframe.

FIG. 10 shows the apparatus of FIGS. 1–8 installed in a doorframe 117*a*. The component 2 is here connected to a door 3*a* and is pivotable about a vertical axis so as to swing the door 3*a* horizontally.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for moving a pivotable component including a gate or a door, comprising a self-supporting frame including a first and a second section and means for attaching the frame to a support; a prime mover mounted on said frame; an output element connectable with the pivotable component and mounted in said first section for movement between first and second positions; means for transmitting motion from said prime mover to said output element so as to move the output element to said first position in response to actuation of said prime mover; and means for biasing said output element to said second position, said biasing means being mounted on said second section.

2. The apparatus of claim 1, wherein said attaching means includes holes in said frame.

3. The apparatus of claim 1, wherein said frame, said prime mover, said output element, said motion transmitting means and said biasing means together constitute a module which is ready for attachment to a support.

4. The apparatus of claim 1, further comprising means for limiting the extent of movability of said output element relative to said frame, including at least one abutment provided on said frame.

5. The apparatus of claim 1, wherein said output element is turnable between said first and second positions and said biasing means comprises at least one torsion spring having convolutions surrounding said output element.

6. The apparatus of claim 5, wherein said convolutions include helical convolutions which loosely surround said output element.

7. The apparatus of claim 5, wherein said torsion spring constitutes the entire biasing means.

8. Apparatus for moving a pivotable gate or analogous mobile component, comprising a self-supporting frame including a first and a second section and means for attaching the frame to a support; a prime mover mounted on said frame; an output element connectable with the mobile component and mounted in said first section for movement between first and second positions; means for transmitting motion from said prime mover to said output element so as to move the output element to said first position in response to actuation of said prime mover; means for biasing said output element to said second position, said biasing means being mounted on said second section; and means for coupling said biasing means to said output element.

9. Apparatus for moving a pivotable gate or an analogous mobile component comprising a self-supporting frame including a first section, a second section, at least one substantially plate-like third section and means for attaching the frame to a support; a prime mover mounted on said frame; an output element connectable with the mobile component and mounted in said first section for movement between first and second positions, said first section including a plurality of flanges extending from one side of said third section and including bearings for said output element; means for transmitting motion from said prime mover to said output element so as to move the output element to said first position in response to actuation of said prime mover;

and means for biasing said output element to said second position, said biasing means being mounted on said second section.

10. The apparatus of claim 9, wherein said flanges are substantially parallel to each other and extend substantially at right angles to said third section.

11. Apparatus for moving a pivotable gate or an analogous mobile component, comprising a self-supporting frame including a first and a second section and means for attaching the frame to a support, said frame comprising a substantially U-shaped portion having a web and two legs constituting or forming part of said first section; a prime mover mounted on said frame; an output element connectable with the mobile component and mounted in said first section for movement between first and second positions; means for transmitting motion from said prime mover to said output element so as to move the output element to said first position in response to actuation of said prime mover; and means for biasing said output element to said second position, said biasing means being mounted on said second section.

12. The apparatus of claim 11, wherein said web constitutes a substantially plate-like third section of said frame and said second section includes extensions of said legs, said third section being disposed between said legs and said extensions.

13. Apparatus for moving a pivotable gate or an analogous mobile component, comprising a self-supporting frame including a first section, a second section, a third section and means for attaching the frame to a support, said frame being H-shaped and including a web constituting said third section a first pair of legs constituting or forming part of said first section, and a second pair of legs constituting or forming part of said second section; a prime mover mounted on said frame; an output element connectable with the mobile component and mounted in said first section for movement between first and second positions; means for transmitting motion from said prime mover to said output element so as to move the output element to said first position in response to actuation of said prime mover; and means for biasing said output element to said second position, said biasing means being mounted on said second section.

14. The apparatus of claim 13, wherein one leg of said second pair of legs has an opening for a portion of said motion transmitting means.

15. The apparatus of claim 13, wherein said web extends transversely of said output element and has at least one portion extending beyond the legs of said second pair of legs, said attaching means being provided in or on said at least one portion of said web.

16. The apparatus of claim 15 wherein said web has two portions extending beyond the legs of said second pair of legs, the legs of said second pair of legs being disposed between said portions of said web and said attaching means being provided in or on each portion of said web.

17. Apparatus for moving a pivotable gate or an analogous mobile component, comprising a self-supporting frame including a first and a second section and means for attaching the frame to a support; a prime mover mounted on said frame; an output element connectable with the mobile component and mounted in said first section for movement between first and second positions; means for transmitting motion from said prime mover to said output element so as to move the output element to said first position in response to actuation of said prime mover; and means for biasing said output element to said second position, said biasing means being mounted on said second section, and said frame further comprising a substantially plate-like third section supporting said prime mover and having at least one aperture for said biasing means.

18. The apparatus of claim 17, wherein said biasing means includes at least one spring which moves relative to said third section in response to movement of said output element between said first and second positions, said aperture having a size such that the spring is out of contact with said third section.

19. The apparatus of claim 18, wherein said biasing means comprises a plurality of springs and said third section has a discrete elongated slot-shaped aperture for each of said springs.

20. The apparatus of claim 19, wherein said apertures form a row and extend transversely of said output element.

21. Apparatus for moving a pivotable gate or an analogous mobile component, comprising a self-supporting frame including a first section, a second section, a third section and means for attaching the frame to a support; a prime mover mounted on said frame; an output element connectable with the mobile component and mounted in said first section for movement between first and second positions; means for transmitting motion from said prime mover to said output element so as to move the output element to said first position in response to actuation of said prime mover; means for biasing said output element to said second position, said biasing means being mounted on said second section; and a support for said frame, said support having a recess with an open side, said third section extending across said open side and said second section and said prime mover being disposed in said recess, said first section and said output element being outwardly adjacent said recess.

22. The apparatus of claim 21, wherein said open side is the upper side of said recess so that said second section is disposed at a level below said third section, said first section extending upwardly beyond the third section of said frame.

23. Apparatus for moving a pivotable gate or an analogous mobile component, comprising a self-supporting frame including a first and a second section and means for attaching the frame to a support; a prime mover mounted on said frame; an output element connectable with the mobile component and mounted in said first section for movement between first and second positions; means for transmitting motion from said prime mover to said output element so as to move the output element to said first position in response to actuation of said prime mover; and means for biasing said output element to said second position, said biasing means being mounted on said second section, said frame including a third section which supports said prime mover and is disposed between said first and second sections, said second section including a substantially rod-shaped carrier for said biasing means.

24. Apparatus for moving a pivotable gate or an analogous mobile component, comprising a self-supporting frame including a first and a second section and means for attaching the frame to a support; a prime mover mounted on said frame; an output element connectable with the mobile component and mounted in said first section for movement between first and second positions, said first section comprising two spaced apart substantially parallel and substantially trapeziform flanges for said output element; means for transmitting motion from said prime mover to said output element so as to move the output element to said first position in response to actuation of said prime mover; means for biasing said output element to said second position, said biasing means being mounted on said second section; and control means for said prime mover, said control means including at least one limit switch on or adjacent said first section.

25. Apparatus for moving a pivotable gate or an analogous mobile component, comprising a self-supporting frame including a first section, a second section, a substantially plate-like third section and means for attaching the frame to a support; a prime mover mounted on said frame, said first section including two flanges one of which is adjacent said prime mover; an output element connectable with the mobile component and mounted in said first section for movement between first and second positions, said output element being turnable between said first and second positions, and said second section including a projection on said output element; means for transmitting motion from said prime mover to said output element so as to move the output element to said first position in response to actuation of said prime mover; and means for biasing said output element to said second position, said biasing means being mounted on said second section and comprising at least one torsion spring having convolutions surrounding said output element, said torsion spring having a first terminal anchored in the other of said flanges and a second terminal anchored in said projection.

* * * * *